US005365496A

United States Patent [19]

Tolan-Samilow

[11] Patent Number: 5,365,496

[45] Date of Patent: Nov. 15, 1994

[54] POTTY TRAINER TIMEPIECE

[76] Inventor: Kathleen R. Tolan-Samilow, 55-1B E. Main St., Flemington, N.J. 08822

[21] Appl. No.: 184,926

[22] Filed: Jan. 24, 1994

[51] Int. Cl.[5] ..... G04P 8/00; G04B 23/00

[52] U.S. Cl. ..... 368/109; 368/261

[58] Field of Search ..... 368/107-109, 368/249, 250, 251, 261, 262

[56] References Cited

U.S. PATENT DOCUMENTS

| | | | |
|---|---|---|---|
| 4,104,865 | 8/1978 | Sasaki | 368/261 |
| 4,187,670 | 2/1980 | Okano . | |
| 4,490,711 | 12/1984 | Johnston . | |
| 4,681,465 | 7/1987 | Nakamura et al. | 368/246 |
| 4,690,566 | 9/1987 | Robertson | 368/108 |
| 4,895,393 | 1/1990 | Shimizu . | |
| 4,949,320 | 8/1990 | Karremberg | 368/109 |
| 5,124,959 | 6/1992 | Yamazaki et al. . | |

*Primary Examiner*—Vit W. Miska

*Attorney, Agent, or Firm*—Kenneth P. Glynn; Stephen J. Driscoll

[57] ABSTRACT

A device for time conditioning children. The device comprises an alarm circuit for producing an alarm signal, an alarm timer for timing an alarm interval and activating the alarm circuit, and an alarm pre-set for providing a user with means to adjust the alarm interval. Additionally, the device comprises an offset timer for timing a delay interval and activating the alarm circuit and a delay pre-set for providing a user with means to adjust the alarm interval. An event switch switches between the alarm timer and the off-set timer and is operated by an event switch control. In one particular embodiment, the device comprises animation circuitry having a central processor unit (CPU), a library of children's stories in memory, and a speech circuit for broadcasting a children's story. This embodiment may also comprise a housing designed to resemble a playful children's character.

20 Claims, 3 Drawing Sheets

POTTY TRAINER TIMEPIECE

BACKGROUND OF THE INVENTION

1. Field of the Invention

The present invention relates generally to a device for time conditioning children, and more specifically to a timepiece for "potty training."

2. Information Disclosure Statement

Many activities in a person's life require scheduling. In that regard, the prior art contains several references to devices which prompt the user to perform a certain activity at a scheduled time. For example, various structures and methods are known for reminding a patient when to take a medicine, for keeping track of appointments, and for turning electrical equipment on and off at pre-set times. These structures include simple recording systems involving paper and pencil as well as complicated recording systems involving paper, pencil and multiple copies carefully arranged in accordance with desired formats.

Electronic reminder systems are also known. Okano, U.S. Pat. No. 4,187,670 discloses an electronic circuit for providing a variable period during which a time signal is generated. This allows the user to pre-set an alarm interval. Time related mechanism specific to particular applications are also known. For example, in Johnston, U.S. Pat. No. 4,490,711, a programmable alarm device is provided to remind people on medication when to take the medication. This device is intended to be programmed for a selected number of alarms per day by elderly and incapacitated people who have no computer or electronic watch programming experience. The device is arranged so that the user can easily ascertain what program schedule has been programmed and what should occur at the alarm times. In a particular embodiment, the device can control the dispensing of medication and record how often the device alarm sounds and is silenced by the user. This provides a record of the patient's affirmation of the need to take medicine.

Although this device provides an alarm to prompt the user to perform an activity, the device makes no allowance for offsetting the alarm in the event the user fails to perform the activity. That is, the prior art fails to provide a user with the means to offset the alarm for a short duration if the user decides not to respond to the alarm. A user of that particular device presumably has the ability to perform the activity without fail; i.e., the user can take the medication. Children, however, may lack the volition to respond to the alarm accordingly. For example, a child cannot take a nap or use the bathroom on command. Therefore, a need exists for a timer which has the ability to be offset in the event the child fails to perform an activity.

In addition to the need for a timer adapted to the behavior of children comes the need for the timer to appeal to children. The need to make time appealing to children is reflected in the prior art. There are various picture books and clock toys used for the purpose of letting infants study a clock and time while they are playing. In Shimizu, U.S. Pat. No. 4,895,393 a picture book is combined with a clock toy to retain the interest of an infant as much as possible and to enhance the effect of study of the clock. With that invention, an infant is made to recognize a specific time and a corresponding life environment illustrated by a picture pattern. Additionally, the device broadcasts the time to enable the infant to recognize time through hearing the sound. In Yamazaki et al., U.S. Pat. No. 5,124,959, the invention is directed at an hour chime clock which conspicuously displays visual effects in connection with the time. One particular embodiment has displaceable hour displaying units marked with hour numerals and ornaments such as dolls or the like concealed behind the hour displaying units. Each displaying unit can be positioned such that the hour numeral is visible and the ornament is concealed or the ornament is displayed and the hour numeral is concealed.

Although these devices make time appealing to children and aid in educating them to read time, they are limited to basically an educational capacity. A need nevertheless exists to introduce children not only to telling time but also to maintaining a schedule.

SUMMARY OF THE INVENTION

The present invention is directed at time conditioning children and having them maintain a schedule. One object of the invention is to provide users with a timer which allows the user to off-set an alarm signal if the child fails to perform the desired event. This is accomplished by using an off-set timer which can be individually adjusted to a particular child's habits. Still another object of this invention is to automatically adjust the time interval in which the alarm sounds. An interval calculator performs this calculation by averaging the time intervals of a predetermined number of events. This average should approximate the child's "natural interval."

It is yet another object of this invention to provide animated features with the device. This is accomplished through animation circuitry which enables the device to broadcast song or stories to entertain the child. By entertaining the child, he or she will more likely stay seated and quiet.

BRIEF DESCRIPTION OF THE DRAWINGS

The features of the present invention are set forth with particularity in the appended claims. The invention may best be understood by reference to the following description taken in conjunction with the accompanying drawings in which like reference numerals identify like elements and in which:

DETAILED DESCRIPTION OF THE PRESENT INVENTION

The present invention is directed at aiding parents in the development and training of their child. A popular view in child rearing is to maintain a high degree of structure in the child's life. This entails establishing routines for activities such as eating, napping, and "potty training." Routines are established by performing the act at regular intervals, or, in other words, time conditioning the child. To that end, the present invention comprises a timing device for the development of children. Although the particular embodiment disclosed pertains to a device for potty training, it should be understood that the device is suited for other applications which require time conditioning such as eating and napping. In this context, the term "event" corresponds to the action of the child, e.g. eating, napping, or using the potty.

Figure 1:
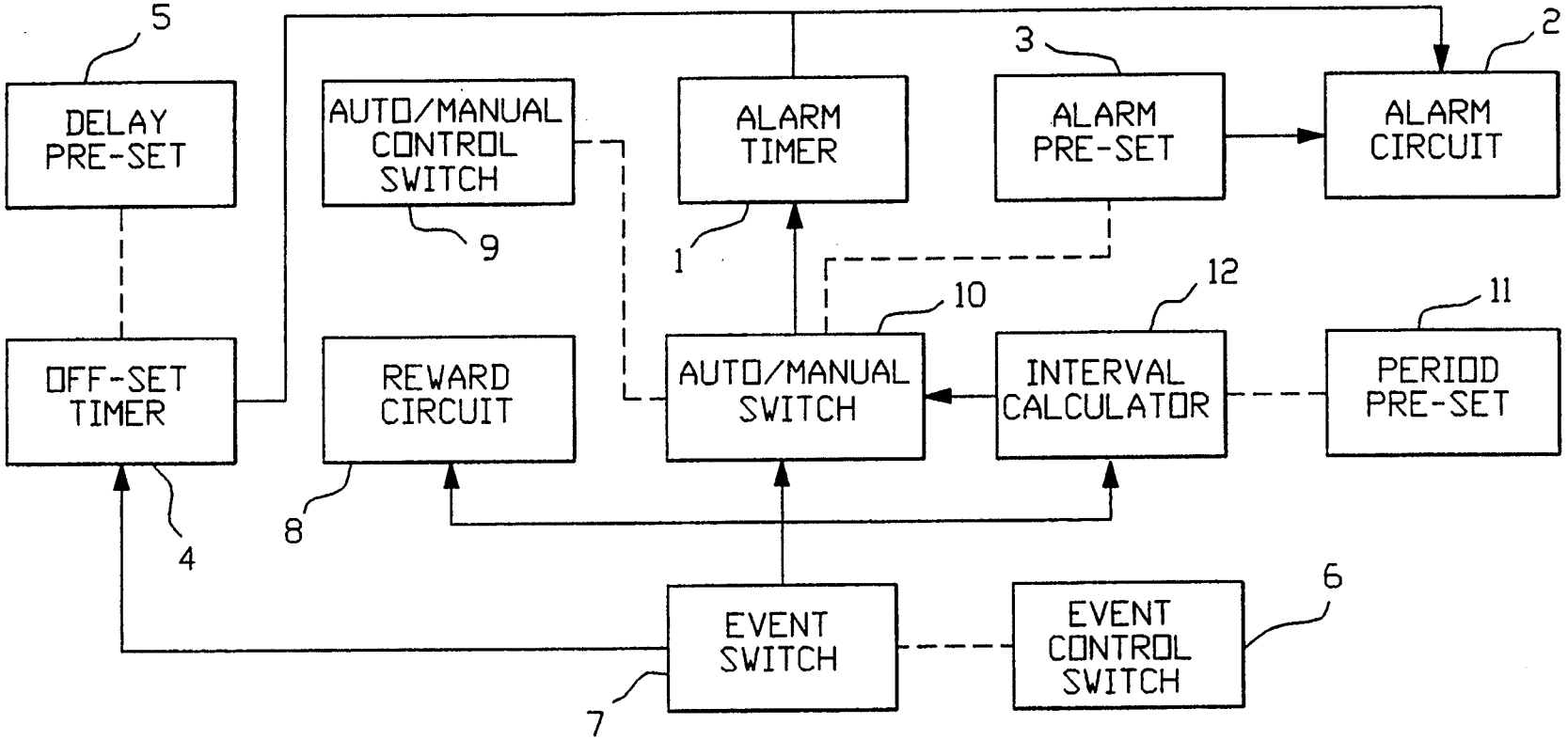
FIG. 1 shows a schematic of the present invention.

A schematic of the present invention is depicted in FIG. 1. That figure shows an alarm timer 1 which activates an alarm circuit 2 at predetermined alarm intervals. When alarm circuit 2 is activated, it produces an alarm signal which may be audio or visual.

If no event occurs following the alarm signal, i.e., the child fails to perform to the user's expectation, the user can activate an off-set timer 4. Off-set timer 4 creates a delay in alarm circuit 2 such that after a delay interval, alarm circuit 2 is reactivated. The delay interval of off-set timer 4 differs from the alarm interval of alarm timer 1, and is presumably shorter. The delay interval can be adjusted by the user via a delay pre-set 5. In this way, the invention provides the user with means to "try again" in a shorter period of time without resetting alarm timer 1.

An event switch 7 is used to control the interaction of alarm timer 1 and off-set timer 4. Following an event, event switch 7 activates alarm timer 1 which causes it to reset and to begin timing. If the no event occurs, event switch activates off-set timer 4 instead of alarm timer 1 which causes off-set timer 4 to reset and to begin timing. Event switch 7 is controlled by event switch control 6 which may be configured such that it activates alarm timer 1 unless event switch control 6 is affirmatively switched. Thus, if the user was not satisfied with the child's performance, the user would operate event switch control 6 to start off-set timer 4. After the delay interval, off-set timer 4 would activate alarm circuit 2. Once alarm circuit 2 is activated by off-set timer, the user is again given the opportunity to try again via event switch control 6. If, however, the user is satisfied with the child's performance, the user simply refrains from switching event switch control 6 and alarm timer 1 is reset and started.

It should be noted that event switch control 6 could be alternatively configured such that off-set timer 4 would be activated as a default. In this case, the user would need to take affirmative action to reset alarm timer 1. This latter embodiment allows a user to reset and start alarm timer 1 if an event occurs before alarm circuitry 2 is activated.

The alarm intervals can be set either by the user via an alarm pre-set 3 or automatically via an interval calculator 12. In either configuration, the alarm interval is set according to the habits of the particular child. An auto/manual switch 10, having an automatic and manual position, controls the interaction of the manual alarm pre-set 3 and interval calculator 12. In the manual position, auto/manual switch 10 couples alarm pre-set 3 to alarm timer 1 while disabling interval calculator 12. In the automatic position, auto/manual switch 10 couples interval calculator 12 to alarm timer 1 while alarm pre-set 3 is disabled. The operation of auto/manual switch 10 is controlled by the user via an auto/manual switch control 9.

This configuration allows interval calculator 12 to collect data regarding the time interval between events. In this context, this time interval is termed the "event period." Interval calculator 12 can average a specified number of event periods to arrive at an average event period. This average event period may then be used as the alarm interval in alarm timer 1. In this way, the alarm interval could be set automatically.

In one preferred embodiment, the specified number of event periods used to calculate the average alarm interval may be entered by the user. FIG. 1 shows a period pre-set 11 which may have several settings from 1 to n event periods. These settings correspond to the latest event periods. For example, if period pre-set 11 is set at just one (1), interval calculator 12 would base the average alarm interval only on the last event period. As period pre-set 11 is increased, the degree of averaging becomes greater.

The recording of an event is controlled by the user via event switch control 6. When the user perceives an event, he or she affirmatively manipulates event switch control 6. This configuration allows interval calculator 12 to compute event periods independent of alarm circuit 2. In other words, if an event occurs before alarm circuit 2 is activated, interval calculator 12 takes that event period into consideration for a more accurate average even though no alarm signal was given.

In addition to controlling off-set timer 4 and interval calculator 12, event switch 7 could control a reward circuit 8. FIG. 1 shows an embodiment of this feature. In this embodiment, a double pole switch is used to activate both alarm timer 1 and reward circuit 8. It should be noted, however, that other embodiments are possible such as two separate switches for retry and reward.

In a preferred embodiment, switches for alarm pre-set 3, delay pre-set 5, event switch control 6, period pre-set 11, and auto/manual switch control 9 are child resistance to prevent the child from altering the device's operation. Child resistant switches may comprise buttons which must be pulled out to function or switches which are recessed and sealed with a cover 32 (see FIG. 3).

Figure 2:
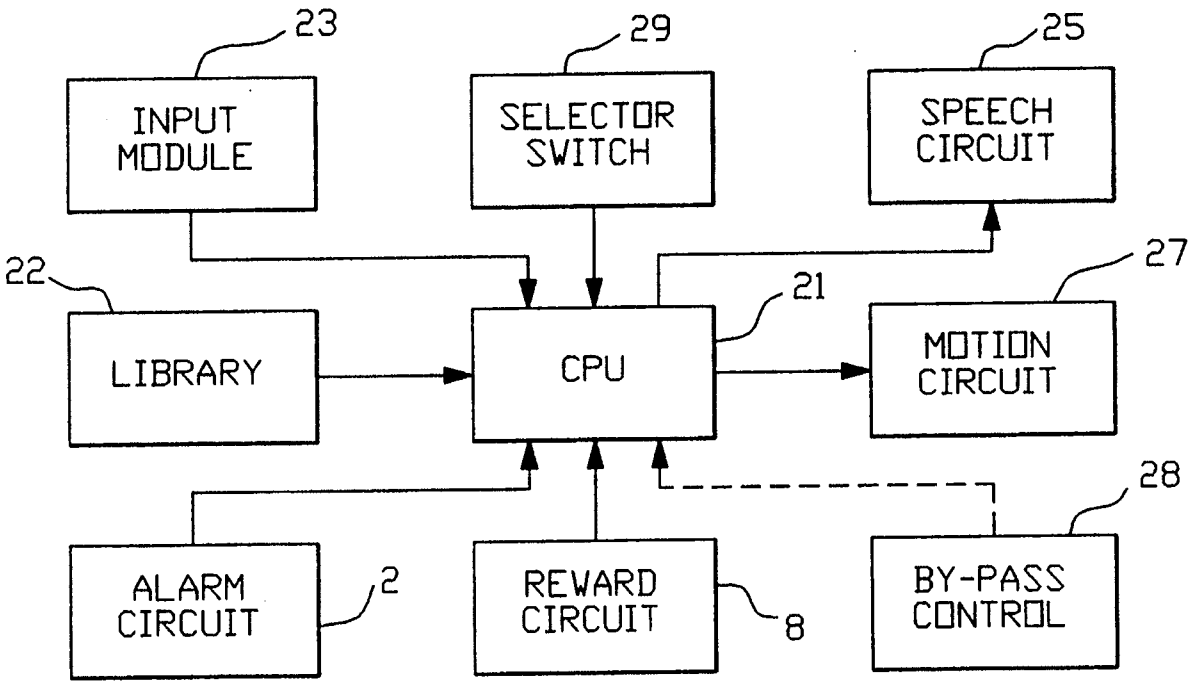
FIG. 2 shows a schematic of the invention having animation circuitry.

In one preferred embodiment, the invention would comprise animation circuitry. A schematic of this is depicted in FIG. 2. This particular embodiment comprises a central processing unit (CPU) 21 which processes signals from alarm circuit 2 and reward circuit 8. CPU 21 also manages information stored in an information library 22. Library 22 contains stories or songs, and in one embodiment comprises a permanent memory storage device such as a micro-chip. Library 22 can be augmented by the user inserting input module 23 into the device. Input module 23 may comprise any known type of information storage device such as a compact disc, magnetic tape, or micro-chip. It is anticipated that input module 23 would be an accessory to the present invention.

CPU 21 processes the signals from alarm circuit 2 and reward circuit 8 and draws upon the information stored in library 22 to operate a speech circuit 28 and a motion circuit 29. Speech circuit 28 broadcasts an alarm, story or song according to CPU 21. Motion circuit 29 moves the device in response to CPU 21. Such movement may be synchronized with the alarm, stories or songs. The selection of the stories or songs played could be determined in CPU 21, or a separate selector switch 29 could provide the user with the means of selecting an appropriate tune or story.

The present invention could take on several different forms. In one preferred embodiment, the device has a housing designed to resemble a playful children's character. The animation circuitry would further bring life to the character enabling it to speak and move. Such a character could read stories or sing to the child to hold the child's interest, thereby keeping him/her seated and quiet. Moreover, if the child performs to the user's satisfaction, these playful characters could be animated to reward him/her for "a job well done." In addition to the alarm and reward circuits controlling the device's animation, one embodiment has a user by-pass 28 to allow the user to circumvent the timers to control the animated features.

Figure 3:
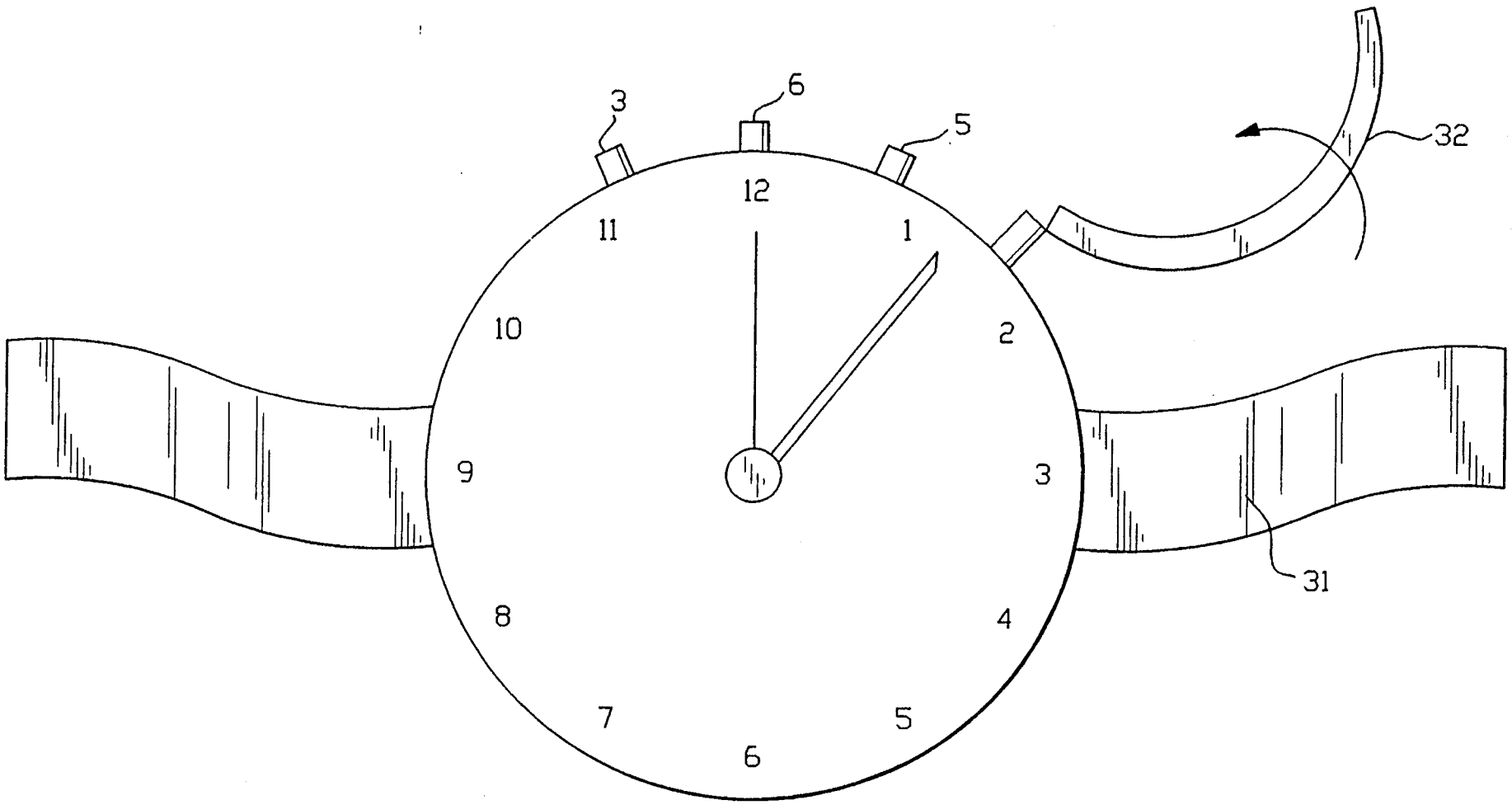
FIG. 3 shows a possible embodiment of the invention having fastening means.

Rather than having animated features, another preferred embodiment of the device comprises fastening means 31 as depicted in FIG. 3. Fastening means 31 entails several configurations including a wrist band, a pendant, or a belt. This would allow the user remain in ear shot of the alarm while performing other tasks around the house.

Obviously, numerous modifications and variations of the present invention are possible in light of the above teachings. It is therefore understood that within the scope of the appended claims, the invention may be practiced otherwise than as specifically described herein.

What is claimed is:

1. A device for time conditioning children, said device comprising:

a. an alarm circuit for producing an alarm signal;

b. an alarm timer for timing an alarm interval and activating said alarm circuit, said alarm timer operatively connected to said alarm circuit;

c. an alarm pre-set for providing a user with means to adjust said alarm interval, said alarm interval pre-set operatively connected to said alarm timer;

d. an offset timer for timing a delay interval and activating said alarm circuit, said offset timer operatively connected to said alarm circuit;

e. a delay pre-set for providing a user with means to adjust said delay interval, said delay pre-set operatively connected to said alarm timer;

f. an event switch for switching between said alarm timer and said off-set timer, said event switch operatively connected to said alarm timer and said off-set timer; and g. an event switch control for providing a user with means to control said event switch to thereby choose between said offset timer and said alarm timer.

2. The device of claim 1 wherein said event switch connects to said alarm timer and said offset timer such that said switch disables said off-set timer and resets and starts said alarm timer when said event switch control is manipulated.

3. The device of claim 2 further comprising:

h. an interval calculator for automatically calculating the alarm interval by averaging the time periods between the manipulation of said event switch control;

i. an auto/manual switch for switching between said interval calculator and said alarm pre-set ; and j. an auto/manual switch control for providing a user with means to control said auto/manual switch.

4. The device of claim 3 further comprising:

k. a period pre-set for providing a user with means to adjust the degree of averaging in said interval calculator.

5. The device of claim 1 wherein said alarm and delay pre-sets and said event switch control comprise child resistant controls constructed to prevent a child from tampering with the device.

6. The device of claim 1 further comprising:

h. animation circuitry operatively connected to said alarm circuit, said animation circuitry comprises:

i. a central processor unit (CPU);

ii. a library of children's stories in memory electrically connected to said CPU; and, iii. a speech circuit for broadcasting a children's story, said speech circuit is electrically connected to said CPU.

7. The device of claim 6 wherein said library includes an input module to expand the selection of children's stories.

8. The device of claim 7 wherein said animation circuitry further comprises:

iv. a selector switch for providing the user with means to select a desired children's song.

9. The device of claim 6 wherein said alarm circuit signals said animation circuitry to broadcast a children's song as said alarm signal.

10. The device of claim 6 further comprising:

i. animated features designed to appeal to young children

11. The device of claim 10 wherein said animated features include a housing for the device resembling a children's character.

12. The device of claim 10 wherein said animation circuitry further comprises iv. motion control circuit for controlling the movement of said animated features, said motion circuit electrically connected to said CPU.

13. The device of claim 12 wherein said motion circuit is configured to be in synchronization with said speech circuit.

14. The device of claim 13 further comprising:

j. a reward circuit for signaling said animation circuitry following a desired event, said reward circuit operatively connected to said animation circuitry.

15. The device of claim 14 wherein said reward circuit is operatively connected to said event switch.

16. The device of claim 6 further comprising:

i. a reward circuit for signaling said animation circuitry following a desired event, said reward circuit operatively connected to said animation circuitry.

17. The device of claim 16 wherein said reward circuit is operatively connected to said event switch.

18. The device of claim 1 wherein said alarm signal comprises a flashing light.

19. The device of claim 1 wherein said alarm signal comprises an audio sound.

20. The device of claim 1 further comprising: g. fastening means for fastening the device to the user, said fastening means are selected from the group consisting of a pendant, a wrist band, and a belt.

* * * * *